US006021899A

United States Patent [19]

Sutherland

[11] Patent Number: 6,021,899

[45] Date of Patent: Feb. 8, 2000

[54] WRAP-AROUND ARTICLE CARRIER

[75] Inventor: Robert L. Sutherland, Kennesaw, Ga.

[73] Assignee: Riverwood International Corporation, Atlanta, Ga.

[21] Appl. No.: 09/244,706

[22] Filed: Feb. 3, 1999

[51] Int. Cl.[7] ..... B65D 65/10; B65D 5/50

[52] U.S. Cl. ..... 206/427; 206/196; 206/434; 229/117.13

[58] Field of Search ..... 206/427, 429, 206/433–435, 140, 193, 196; 229/117.13, 117.16, 132, 137

[56] References Cited

U.S. PATENT DOCUMENTS

| | | | |
|---|---|---|---|
| 2,911,136 | 11/1959 | Stone | 229/117.13 |
| 2,990,997 | 7/1961 | Weiss | 206/434 |
| 4,164,286 | 8/1979 | Sutherland | 206/434 |
| 4,216,861 | 8/1980 | Oliff | 206/427 |
| 4,482,090 | 11/1984 | Milliens | 229/117.13 |
| 4,785,991 | 11/1988 | Schuster | 206/427 |
| 4,941,624 | 7/1990 | Schuster | 229/117.13 |
| 5,002,186 | 3/1991 | Cooper | 206/433 |
| 5,221,042 | 6/1993 | Oliff | 229/117.13 |
| 5,292,059 | 3/1994 | Oliff | 229/137 |

*Primary Examiner*—Bryon P. Gehman

[57] ABSTRACT

A wrap-around article carrier, comprising a bottom panel having opposing side edges and further having opposing end edges, a first side panel and an opposing second side panel, and a top panel having opposing side edges. Each one of the side panels has a top edge and an opposing bottom edge that is connected to one of the side edges of the bottom panel. The side edges of the top panel are connected to one of the top edges of the side panels. The carrier further has a first end panel and an opposing second end panel. Each of the end panels has a bottom edge that is connected to one of the end edges of the bottom panel. The carrier further has an article holder connected to the top panel. The article holder contacts and secures the top of articles contained within the carrier.

17 Claims, 3 Drawing Sheets

WRAP-AROUND ARTICLE CARRIER

BACKGROUND OF THE INVENTION

1. Field of the Invention

The present invention relates, generally, to article carriers. More particularly, the invention relates to wrap-around article carriers formed by wrapping a flat carrier blank around a product configuration.

2. Background Information

Wrap-around article carriers are commonly used to package beverage cans and other articles. Basically, wrap-around article carriers are formed by grouping articles in an arrangement they are desired to be in after packaging to form a product configuration, and then wrapping a flat carrier blank around the product configuration. The blank is tightly drawn about the articles and the ends of the blank are connected to each other. Cutouts are often provided at the upper and lower portion of the side panels in order to grip the end portions of articles protruding through the cutouts. The cutouts allow the blank to be tightly wrapped around and to securely hold the product group. Wrap-around article carriers are economical to make and use because they typically use a smaller amount of paperboard than other cartons, and because they are stored and transported as a flat carrier blank rather than as a carton sleeve. Furthermore, wrap-around article carriers are sturdy and are well-accepted by the public.

The state of the art is believed to have limitations and shortcomings. Wrap-around article carriers by their nature have been limited as to the number of articles they can hold before articles will spill out of the open ends of the article carrier. Normally, articles are arranged in two adjacent rows allowing the sides of the carrier to engage the outer portions of all of the articles in the carrier while the inner portions of the articles abut against each other. The end portions of the articles extend through the cutouts in the side panel, which prevent the articles from spilling through the open ends of the carrier. If three rows of articles were to be packaged in one of these wraparound article carriers, the articles in the middle row would not be in contact with the carrier, but would be held in place only by the pressure exerted by adjacent articles in the adjacent outer rows. Therefore, attempting to package a three-row product group using a typical known wrap-around article carriers increases the risk of the articles spilling out through the open ends of the carrier. Because this type of wrap-around article carriers normally can accommodate only two rows of articles, the number of articles that can be packaged is governed to a large extent by the desirable length of the package. Packages containing six articles are the most common, although packages containing eight articles can also be conveniently handled. Packages containing more than eight articles are not convenient to handle.

U.S. Pat. No. 5,611,431, assigned to Applicant's assignee, shows a wraparound article carrier for packaging three rows of articles. The '431 carrier is capable of conveniently packaging large numbers of articles, including product configurations of up to twenty-four. A separate reinforcement strip having clip-type support panels is glued to the underside of the top panel of the carrier. These support panels support the articles of the middle row and prevent the end articles from spilling through the open ends of the carrier. The reinforcement strip also helps form a two-ply handle for the carrier.

Applicant's invention provides a wrap-around article carrier which is believed to constitute an improvement over the known art.

BRIEF SUMMARY OF THE INVENTION

The present invention provides a wrap-around article carrier which generally comprises opposing side panels foldably connected to both a bottom panel and a top panel. Opposing end panels are likewise foldably connected to the bottom panel and are further foldably connected to the side panels via bottom gussets. The end panels are formed and held in place by sandwiching the gussets between the product configuration and the side panels. The height of the opposing end panels is preferably less than the height of the side panels. The side panels have a top margin or bevel panel section formed by a score line, and further have cutouts in the side panels to help secure the articles in the carrier. The top panel of the carrier is formed from a glue or first top panel and a second top panel that overlaps and is attached to the first top panel. An article holder is attached or connected to one of the top panels. The article holder is configured to contact and help secure the top of at least one of the articles in the carrier. The end panels, the cutouts, and the article holder work together to hold the articles within the carrier and allow the carrier to hold larger product configurations.

The wrap-around article carrier of the present invention includes an article holder and end panels for securing articles within the carrier. The end panels are attached to the side panels via gussets, each comprising both a first and a second web panel, to simplify the construction of the carrier, particularly the end panels.

The features, benefits and objects of this invention will become clear to those skilled in the art by reference to the following description, claims and drawings.

DETAILED DESCRIPTION

Figure 1:
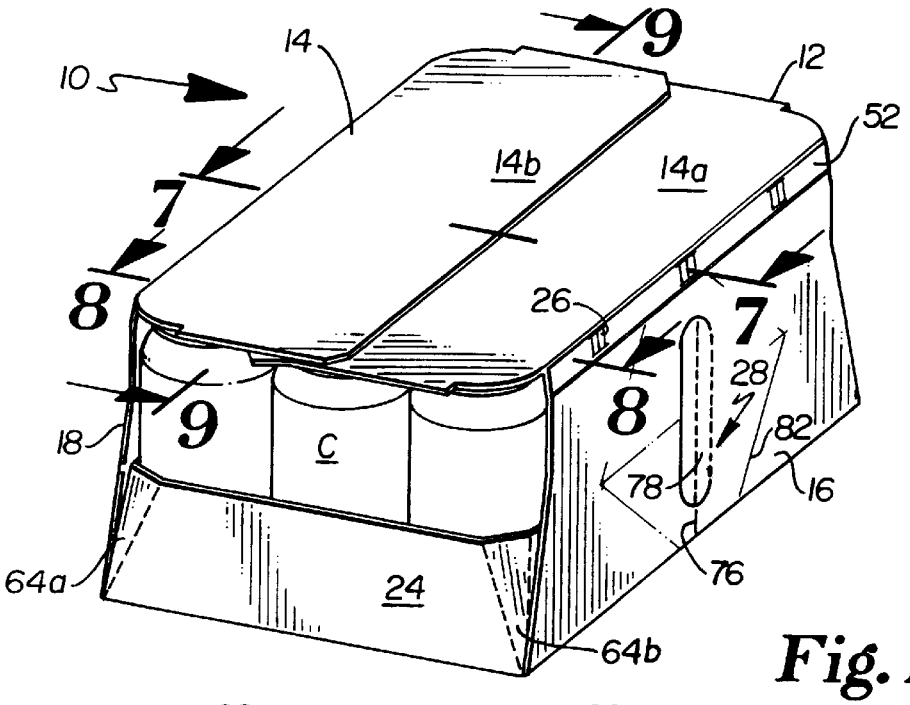
FIG. 1 is a perspective view of a wrap-around article carrier of the present invention.

Referring to FIG. 1, a package 10 is comprised of a wrap-around article carrier 12 and twelve beverage cans C contained within the carrier. The twelve cans form a product configuration of three adjacent rows by four adjacent columns. The carrier 12 includes a top panel 14 connected to side panels 16 and 18, which in turn are connected to a bottom panel 20, shown in FIGS. 3–4. The carrier 12 further includes end panels 22 and 24 that are foldably connected to the bottom panel 20 and the side panels 16 and 18 by gussets. Cutouts 26 in the upper portion of the side panels 16 and 18 are located between adjacent columns of the cans.

Figure 2:
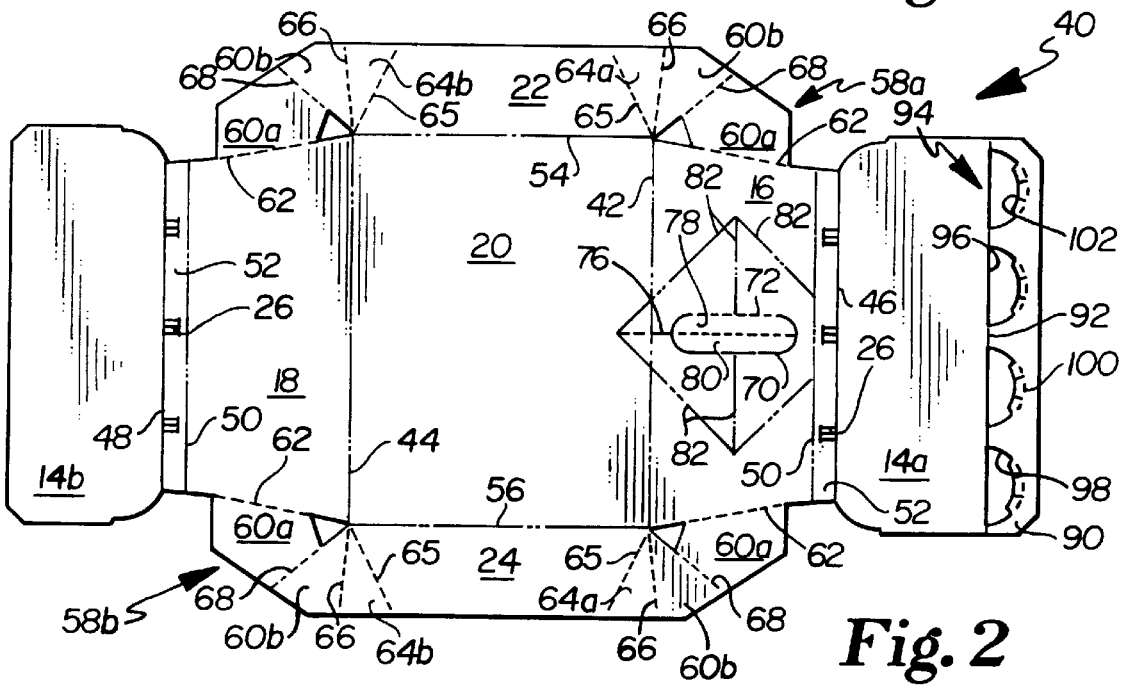
FIG. 2 is a plan view of a blank for forming the main wrap-around portion of the carrier of FIG. 1.
Figure 9:
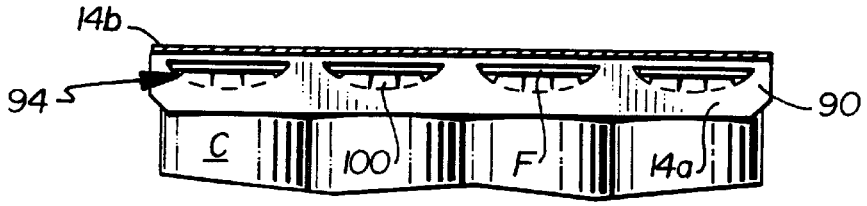
FIG. 9 is a partial cross-sectional view taken along line 9—9 of FIG. 1.

Referring to FIG. 2, a primary blank 40 for forming the wrap-around article carrier 12 shown in FIG. 1 is a generally rectangular sheet of paperboard or other material having sufficient strength and flexibility to be folded into place and function as a carrier. Bottom panel section 20 is connected by fold line 42 to side panel section 16 and by fold line 44 to side panel section 18. The side panel section 16 is connected to a glue or top panel flap 14*a* by fold line 46, and the side panel section 18 is connected to a top panel flap 14*b* by fold line 48. The top panel flap 14*b* overlaps and is glued to the top panel flap 14*a* to form the top panel 14 shown in FIG. 1. Fold lines 50 are spaced a short distance from fold lines 46 and 48 to form bevel panel sections or top margins 52. The cutouts 26 are formed within the margins 52. The cutouts 26 are preferably formed by an I-shaped cut which form two tabs that fold about vertical lines into the carrier 12 and away from each other. The cutouts 26 on each side panel are spaced at intervals along the margins 52 that allow the tabs to extend between adjacent columns of cans C and help secure the cans within the carrier. The cans do not extend through the cutouts. The top margins 52 allow the side panels 16 and 18 to conform to the shape of the top of the cans, particularly when the carrier 12 is undergoing lifting stresses.

The bottom panel section 20 is connected to an end panel flap 22 by fold line 54 and to an end panel flap 24 by fold line 56. A first gusset 58*a* connects both end panels 22 and 24 to the first side panel section 16, and a second gusset 58*b* connects both end panels 22 and 24 to the second side panel 18. Each gusset 58*a* and 58*b* has a first web panel 60*a* foldably connected to the side panels 16 and 18 by fold lines 62, and further has a second web panel 60*b* foldably connected to the end panels 22 and 24 by fold lines 66 and to the first web panel 60*a* by fold lines 68. Each of the end panels 22 and 24 include a first bevel portion 64*a* and a second bevel portion 64*b*. Each of the bevel portions 64*a* and 64*b* within the end panels 22 and 24 are defined by a fold line 65. The first bevel portions 64*a* are connected to the first gussets 58*a* and the second bevel portions 64*b* are connected to the second gussets 58*b*. The bevel portions 64*a* and 64*b* are foldably connected to the second web panels 60*b* at the fold lines 66. The fold lines 62, 66, and 68 are oriented and arranged to cause the web panels 60*a* and 60*b* of each gusset 58*a* and 58*b* to fold adjacent to one of the side panels 16 and 18 and to fold the end panels 22 and 24 up into position. The product configuration sandwiches the web panels 60*a* and 60*b* between the side panels 16 and 18 and an article, and thus maintains the end panels 22 and 24 in position without the extra step of adhering the gussets 58*a* and 58*b* to the end panels 22 and 24.

A handle 28, shown in FIG. 1, is formed by creating an opening in the side panel section 16. The handle 28 is defined by a perforated edge 70 and a fold line 72 which create a tab 74 that folds into the carrier. A score line 76 dissects the tab 74 into a beveled portion 78 and a distal portion 80, and extends a short distance into the bottom panel section 20. The beveled portion 78 and distal portion 80 of the tab 74 follow the cylindrical contour of a can in the carrier. The side panel section 16 has a pattern of stress-reducing score lines 82 which are positioned around the handle 28 and extend a short distance into the bottom panel section 20. These score lines 82 distribute the stresses that occur when the package 10 is lifted by the handle 28.

Figure 3:
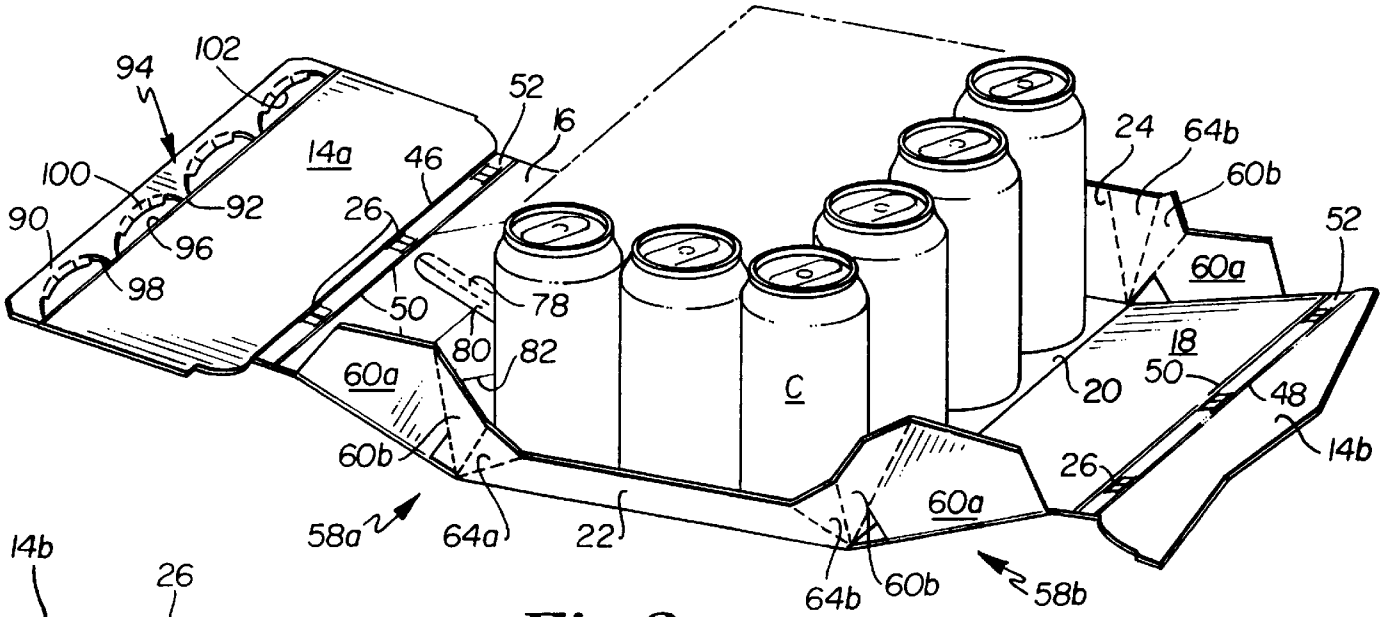
FIG. 3 is a perspective view illustrating the end panels of the blank of FIG. 2 being folded around an article group.
Figure 5:
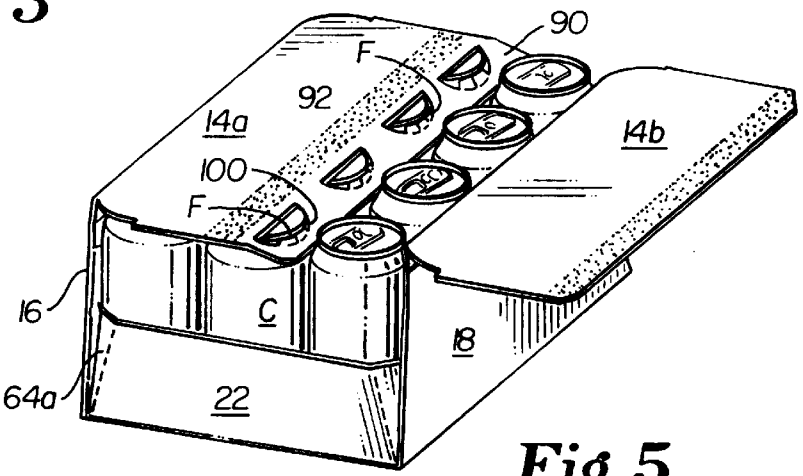
FIG. 5 is perspective view of a partially constructed carrier of FIG. 3 after the side panels and first panel top have been folded into place.
Figure 4:
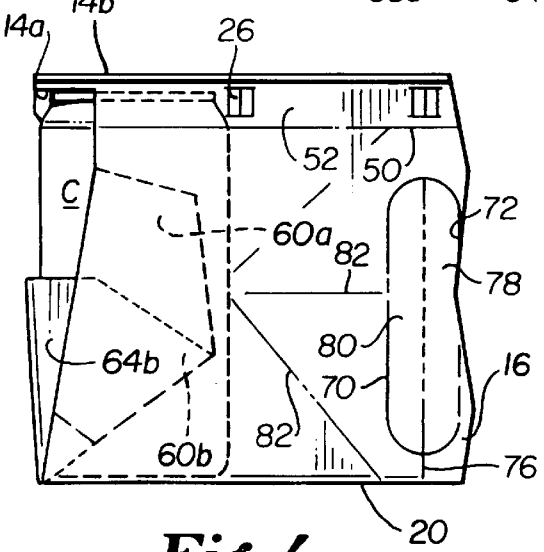
FIG. 4 is a partial side view illustrating the folded web panels of a gusset of the carrier of FIG. 1.
Figure 7:
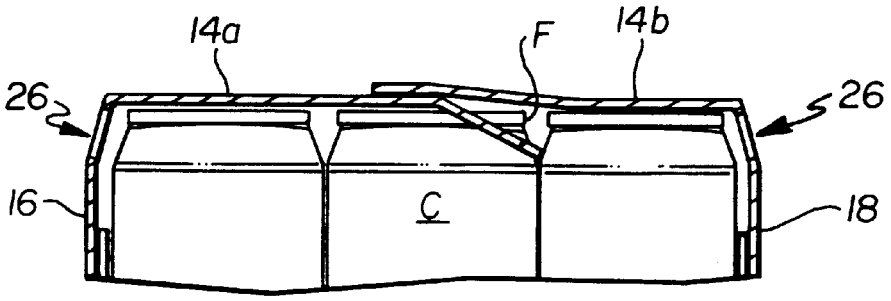
FIG. 7 is a partial cross-sectional view along line 7—7 of FIG. 1.
Figure 8:
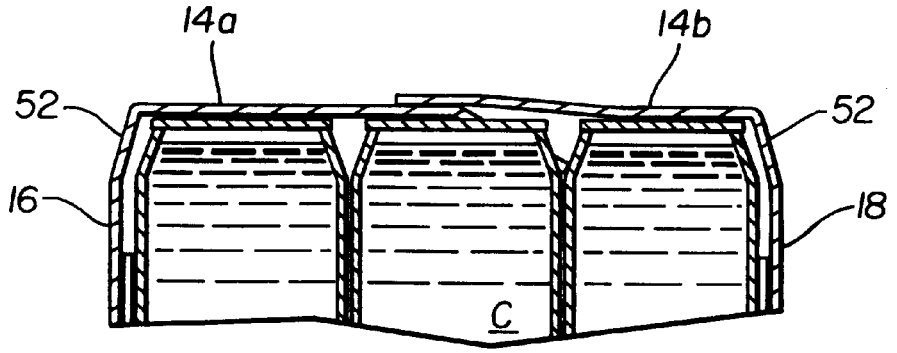
FIG. 8 is a partial cross-sectional view taken along line 8—8 of FIG. 1.

As shown in FIGS. 2, 3 and 5, a lock flap 90 is connected to the top panel flap 14*a* by fold line 92. The lock flap 90 contains can lock chimes 94 and forms an article holder for contacting and supporting the tops of the cans within the carrier 12. The can lock chimes 94 are semi-circular openings defined by a diametric edge 96 along fold line 92 and a peripheral edge 98. The peripheral edge 98 is cut and scored in a manner to form tabs 100 opposite from the diametric edge 96. These tabs 100 fold along the peripheral edge 98 and have curved interior edges 102 that conform to the shape of a chime or flange F of a can C. The chimes 94 are sized and arranged to slide over the top of the cans C in the carrier 12 when the lock flap 90 is folded or clipped over the cans. As shown in greater detail in FIGS. 5 and 7, the tabs 100 slide over and engage or lock with the flange F of a can C, thus holding or stabilizing the top of the can C within the carrier 12. The chimes 94 engage the four article tops in the middle row of a three row by four column product configuration.

Figure 6:
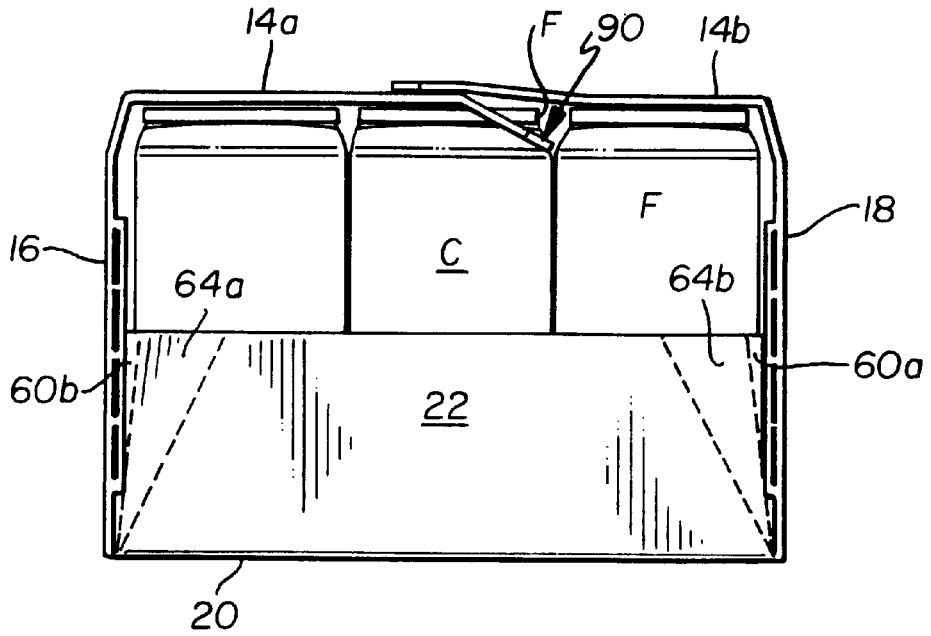
FIG. 6 is an end view of the wrap-around article carrier of FIG. 1.

To form a package 10 from the blank 40, twelve beverage cans are arranged into a product configuration comprising three rows and four columns as illustrated in FIG. 3, and are positioned on the bottom panel section 20. The blank 40 is schematically shown in FIG. 3 as being positioned in a partially folded condition, wherein the end panels 22 and 24 have been folded upward and the gussets 58*a* and 58*b* are beginning to be folded along the product configuration. The side panels 16 and 18 are folded up to sandwich the gussets 58*a* and 58*b* between the side panels and the product configuration. The top panel 14*a* is folded over the cans C and the lock flap 90, which forms the article holder, is further folded to cause the can lock chimes 94 to extend around and lock with the flanges F of the cans C in the center row as illustrated in FIG. 5. Glue is applied to the stippled areas shown in FIG. 5, and the top panel 14*b* is folded over and glued onto the top panel 14*a* to form the carrier 12 illustrated in FIGS. 1 and 6. The end panels 22 and 24 of a formed carrier 12 are held in place because the side web panels 60*a* and 60*b* are sandwiched between the side panels 16 and 18 and the product configuration. The end panels 22 and 24 cannot fold down unless the relatively ridged side web panels 60*a* and 60*b* bend. Thus, the gussets 58*a* and 58*b* do not have to be glued to the end panels 22 and 24 or the side panels 16 and 18.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A wrap-around article carrier for containing a product formation defined by adjacent rows and adjacent columns of articles, comprising:

(a) a bottom panel having opposing side edges and opposing end edges;

(b) a first side panel and an opposing second side panel, each of said side panels having a top edge and an opposing bottom edge, said bottom edge of each of said side panels being connected to one of said side edges of said bottom panel, said side panels having at least one cutout, said at least one cutout having opposing tabs, said at least one cutout being aligned between adjacent columns of articles;

(c) a first end panel and an opposing second end panel, each of said end panels having a bottom edge, said bottom edge of each of said end panels being connected to one of said end edges of said bottom panel, each of said end panels further having a first bevel panel portion and a second bevel panel portion, each of said bevel portions being defined within said end panels by a fold line;

(d) a first gusset foldably connected to said first bevel portion of each end panel and a second gusset foldably connected to said second bevel portion of each end panel, said first gussets being foldably connected to said first side panel, said second gussets being foldably connected to said second side panel; and (e) a top panel, said top panel including a first top panel and a second top panel, said first top panel having a side said first top panel having a side edge attached to said top edge of said first side panel, said second top panel having a side edge attached to said top edge of said second side panel, said second top panel being overlapped and attached to said first top panel.

2. The carrier of claim 1, wherein said first side panel further has a handle opening.

3. The carrier of claim 1, wherein said carrier further comprises an article holder connected to one of said top panels, said carrier containing a product configuration of a plurality of articles, each of said articles having a top and a bottom, said article holder being in contact with at least one of said article tops.

4. The carrier of claim 3, wherein an article holder includes at least one chime adapted to receive said article top.

5. The carrier of claim 4, wherein said chime is adapted to receive a top flange of a beverage can.

6. The carrier of claim 3, wherein said article holder is a lock flap connected to said first top panel by a fold line, said lock flap having at least one chime.

7. The carrier of claim 6, wherein said chime is a semi-circular opening defined by a diametric edge and a peripheral edge, said opening being sized to receive a top of an article, said diametric edge being formed along said fold line defining said lock flap, said peripheral edge being cut and scored to form at least one tab.

8. The carrier of claim 6, wherein said carrier contains twelve articles in a product configuration of three rows by four columns.

9. A wrap-around beverage can carrier for containing a product formation defined by adjacent rows and adjacent columns of cans, each of said cans having a top flange, comprising:

(a) a bottom panel having opposing side edges and opposing end edges;

(b) a first side panel and an opposing second side panel, each of said side panels having a top edge and an opposing bottom edge, said bottom edge of each of said side panels being connected to one of said side edges of said bottom panel, said side panels having at least one cutout, said at least one cutout having opposing tabs, said at least one cutout being aligned between adjacent columns of articles, said first side panel having a handle opening;

(c) a first end panel and an opposing second end panel, each of said end panels having a bottom edge, said bottom edge of each of said end panels being connected to one of said end edges of said bottom panel, each of said end panels further having a first bevel panel portion and a second bevel panel portion, each of said bevel portions being defined within said end panels by a fold line;

(d) a first gusset foldably connected to said first bevel portion of each end panel and a second gusset foldably connected to said second bevel portion of each end panel, said first gussets being foldably connected to said first side panel, said second gussets being foldably connected to said second side panel, each of said gussets including a first web panel and a second web panel, said first web panel being foldably connected to said second web panel at a first fold line, said first web panel being foldably connected to one of said side panels at a second fold line, said second web panel being foldably connected to one of said bevel panel portions in one of said end panels at a third fold line, said first web panel being folded about said second fold to be adjacent to said side panel and said second web panel being folded about said first fold line to be adjacent to said first web panel;

(e) a top panel, said top panel including a first top panel and a second top panel, said first top panel having a side said first top panel having a side edge attached to said top edge of said first side panel, said second top panel having a side edge attached to said top edge of said second side panel, said second top panel being overlapped and attached to said first top panel; and (f) an article holder connected to said top panel, said article holder being in contact with said top flange of at least one of said beverage cans.

10. A flat blank for forming an article carrier, comprising:

(a) bottom panel having opposing side edges and further having opposing end edges;

(b) a first side panel and an opposing second side panel, each of said side panels having a top edge and an opposing bottom edge, said bottom edge of each of said side panels being connected to one of said side edges of said bottom panel;

(c) a first top panel and a second top panel, said first top panel having a side edge attached to said top edge of said first side panel, said second top panel having a side edge attached to said stop edge of said second side panel, said second top panel adapted to be overlapped and attached to said first top panel in an article carrier formed from said flat blank;

(d) a first end panel and an opposing second end panel, each of said end panels having a bottom edge, said bottom edge of each of said end panels being connected to one of said end edges of said bottom panel;

(e) a first gusset and a second gusset foldably connected to each of said first and second end panels, said first gussets being foldably connected to said first side panel, said second gussets being foldably connected to said second side panel; and (f) each of said gussets includes a first web panel and a second web panel, said first web panel being foldably connected to said second web panel at a first fold line, said first web panel being foldably connected to one of said side panels at a second fold line, said second web panel being foldably connected to one of said end panels at a third fold line.

11. The flat blank of claim 10, wherein said first side panel has a handle opening.

12. The flat blank of claim 10, wherein said side panels have at least one cutout adjacent to said top edge, said at least one cutout having opposing tabs.

13. The flat blank of claim 10, wherein each of said end panels has a first bevel panel portion connected to said first gusset and a second bevel panel portion connected to said second gusset, each of said bevel portions being defined within said end panels by a fold line, said bevel panel portions being foldably connected to said second web panels at said third fold lines.

14. The flat blank of claim 10, further comprising an article holder attached to one of said top panels, said article holder having a form to engage and secure at least one article top in an assembled article carrier.

15. The flat blank of claim 14, wherein said article holder is a lock flap connected to said first top panel by a fold line, said lock flap having at least one chime for engaging and securing the at least one article top.

16. A flat carrier blank for forming an article carrier, comprising:

(a) a bottom panel having opposing side edges and opposing end edges;

(b) a first side panel and an opposing second side panel, each of said side panels having a top edge and an opposing bottom edge, said bottom edge of each of said side panels being connected to one of said side edges of said bottom panel, said side panels having at least one cutout adjacent to said top edge, said at least one cutout having opposing tabs;

(c) a first top panel and a second top panel, said first top panel having a side edge attached to said top edge of said first side panel, said second top panel having a side edge attached to said top edge of said second side panel, said second top panel adapted to be overlapped and attached to said first top panel in an article carrier formed from said flat carrier blank;

(d) a first end panel and an opposing second end panel, each of said end panels having a bottom edge, said bottom edge of each of said end panels being connected to one of said end edges of said bottom panel; and (e) a first gusset and a second gusset, each of said gussets being foldably connected to each of said first and second end panels, said first gussets being foldably connected to said first side panel, said second gussets being foldably connected to said second side panel, each of said gussets including a first web panel and a second web panel, said first web panel being foldably connected to said second web panel at a first fold line, said first web panel being foldably connected to one of said side panels at a second fold line, said second web panel being foldably connected to one of said end panels at a third fold line.

17. A flat carrier blank for forming a beverage can carrier, comprising:

(a) a bottom panel having opposing side edges and opposing end edges;

(b) a first side panel and an opposing second side panel, each of said side panels having a top edge and an opposing bottom edge, said bottom edge of each of said side panels being connected to tone of said side edges of said bottom panel, said side panels having at least one cutout adjacent to said top edge, said at least one cutout having opposing tabs, said first side panel having a handle opening;

(c) a first top panel and a second top panel, said first top panel having a side edge attached to said top edge of said first side panel, said second top panel having a side edge attached to said top edge of said second side panel, said second top panel adapted to be overlapped and attached to said first top panel in a beverage can carrier formed from said flat carrier blank;

(d) a first end panel and an opposing second end panel, each of said end panels having a bottom edge, said bottom edge of each of said end panels being connected to one of said end edges of said bottom panel, each of said end panels further having a first bevel portion connected to said first gusset and a second bevel panel portion connected to said second gusset, each of said bevel portions being defined within said end panels by a fold line;

(e) a first gusset and a second gusset, each of said gussets being foldably connected to each of said first and second end panels, said first gussets being foldably connected to said first side panel, said second gussets being foldably connected to said second side panel, each of said gussets including a first web panel and a second web panel, said first web panel being foldably connected to said second web panel at a first fold line, said first web panel being foldably connected to one of said side panels at a second fold line, said second web panel being foldably connected to one of said bevel panel portions of said end panels at a third fold line; and (f) an article holder connected to one of said top panels, said article holder having a form to engage and secure tops of cans contained by an assembled beverage can carrier.

* * * * *